US010155131B2

(12) United States Patent
Machovina et al.

(10) Patent No.: US 10,155,131 B2
(45) Date of Patent: Dec. 18, 2018

(54) EXERCISE ASSEMBLY FOR PERFORMING DIFFERENT ROWING ROUTINES

(71) Applicant: Coreyak LLC, Coral Gables, FL (US)

(72) Inventors: Brian Machovina, Coral Gables, FL (US); Eileen McHale-Machovina, Coral Gables, FL (US)

(73) Assignee: COREYAK LLC, Coral Gables, FL (US)

( * ) Notice: Subject to any disclaimer, the term of this patent is extended or adjusted under 35 U.S.C. 154(b) by 0 days.

(21) Appl. No.: 15/627,740

(22) Filed: Jun. 20, 2017

(65) Prior Publication Data

US 2017/0361153 A1 Dec. 21, 2017

Related U.S. Application Data

(63) Continuation-in-part of application No. 15/367,289, filed on Dec. 2, 2016.
(Continued)

(51) Int. Cl.
*A63B 22/00* (2006.01)
*A63B 69/06* (2006.01)
(Continued)

(52) U.S. Cl.
CPC ..... *A63B 22/0076* (2013.01); *A63B 21/0088* (2013.01); *A63B 21/153* (2013.01);
(Continued)

(58) Field of Classification Search
CPC ..... A63B 21/0088; A63B 21/153; A63B 21/00069; A63B 22/0076; A63B 22/0087;
(Continued)

(56) References Cited

U.S. PATENT DOCUMENTS 2,725,231 A 11/1955 Hoover
3,586,322 A 6/1971 Kverneland
(Continued)

FOREIGN PATENT DOCUMENTS

WO WO 92/00780 1/1992
WO WO 2004/112918 12/2004
WO 2017223040 A1 12/2017

*Primary Examiner* — Joshua Lee
(74) *Attorney, Agent, or Firm* — Malloy & Malloy, PL

(57) ABSTRACT

An exercise assembly structured to perform different rowing routines characterized different rowing motions. A resistance device is movable within a chamber and is cooperatively structured therewith to resist such movement. A drive assembly includes two drive sections each independently connected in driving relation to said resistance device. A connector structure includes two connector members each attached to a handle and connected in driving relation to a different one of said drive sections. The handle is selectively movable through the plurality of different rowing motions, at least one of which results in the two drive sections concurrently driving the resistance member and being concurrently driven by the two connector members. At least one other rowing motion of the handle is defined by each drive section alternately driving the resistance member and being alternately driven by interconnected ones of said connector members.

5 Claims, 7 Drawing Sheets

Related U.S. Application Data

(60) Provisional application No. 62/419,618, filed on Nov. 9, 2016, provisional application No. 62/352,202, filed on Jun. 20, 2016.

(51) Int. Cl.

| | |
|---|---|
| ***A63B 71/06*** | (2006.01) |
| ***A63B 21/008*** | (2006.01) |
| ***A63B 21/00*** | (2006.01) |
| *A63B 22/20* | (2006.01) |

(52) U.S. Cl.

CPC ..... *A63B 69/06* (2013.01); *A63B 71/0622* (2013.01); *A63B 21/00069* (2013.01); *A63B 22/0087* (2013.01); *A63B 22/203* (2013.01); *A63B 2022/0033* (2013.01); *A63B 2022/0079* (2013.01); *A63B 2071/0638* (2013.01); *A63B 2220/17* (2013.01); *A63B 2220/30* (2013.01); *A63B 2220/40* (2013.01); *A63B 2220/53* (2013.01); *A63B 2220/803* (2013.01); *A63B 2225/09* (2013.01); *A63B 2225/50* (2013.01)

(58) Field of Classification Search

CPC ..... A63B 22/0889; A63B 22/203; A63B 2022/0033; A63B 2022/0079; A63B 2022/0082; A63B 2022/0084; A63B 69/06; A63B 2069/062; A63B 2069/064; A63B 2069/066; A63B 2069/068; A63B 71/0622; A63B 2071/0638; A63B 2220/17; A63B 2220/30; A63B 2220/40; A63B 2220/53; A63B 2220/803; A63B 2225/09; A63B 2225/50

See application file for complete search history.

(56) References Cited

U.S. PATENT DOCUMENTS

| | | | | |
|---|---|---|---|---|
| 4,396,188 | A | 8/1983 | Dreissigacker et al. | |
| 4,537,396 | A | 8/1985 | Hooper | |
| 4,625,962 | A | 12/1986 | Street | |
| 4,647,035 | A | 3/1987 | Yellen | |
| 4,674,741 | A | 6/1987 | Pasierb, Jr. et al. | |
| 4,687,197 | A | 8/1987 | Larsson et al. | |
| 4,717,145 | A | 1/1988 | Chininis | |
| 4,735,410 | A | 4/1988 | Nobuta | |
| 4,772,013 | A | 9/1988 | Tarlow, Jr. | |
| 4,798,378 | A | 1/1989 | Jones | |
| 4,880,224 | A | 11/1989 | Jonas et al. | |
| 4,940,227 | A | 7/1990 | Coffey | |
| 4,997,181 | A | 3/1991 | Lo | |
| 5,565,002 | A | 10/1996 | Rawls et al. | |
| 5,624,357 | A | 4/1997 | Englehart et al. | |
| 5,803,876 | A | 9/1998 | Hickman | |
| 5,947,868 | A | 9/1999 | Dugan | |
| 5,989,157 | A | 11/1999 | Walton | |
| 6,328,677 | B1 | 12/2001 | Drapeau | |
| 6,545,661 | B1 | 4/2003 | Goschy et al. | |
| 6,561,955 | B1 | 5/2003 | Dreissigacker et al. | |
| 6,569,065 | B1 | 5/2003 | Menold et al. | |
| 7,192,387 | B2 | 3/2007 | Mendel | |
| 7,201,708 | B2 | 4/2007 | Dreissigacker et al. | |
| 7,335,143 | B2 | 2/2008 | Lundahl | |
| 7,614,987 | B2 | 11/2009 | Guadagno | |
| 7,628,739 | B2 | 12/2009 | Gearon | |
| 7,846,079 | B1 | 12/2010 | Eaglin | |
| 7,927,253 | B2 | 4/2011 | Vincent et al. | |
| 7,967,728 | B2 | 6/2011 | Zavadsky et al. | |
| 8,025,607 | B2 | 9/2011 | Ranky et al. | |
| 8,042,391 | B2 | 10/2011 | Ye | |
| 8,060,337 | B2 | 11/2011 | Kulach et al. | |
| 8,210,997 | B2 | 7/2012 | Thomas et al. | |
| 8,221,290 | B2 | 7/2012 | Vincent et al. | |
| 8,239,146 | B2 | 8/2012 | Vock et al. | |
| 8,241,186 | B2 | 8/2012 | Brodess et al. | |
| 8,506,458 | B2 | 8/2013 | Dugan | |
| 8,556,778 | B1 | 10/2013 | Dugan | |
| 8,560,267 | B2 | 10/2013 | Jangle et al. | |
| 8,608,626 | B2 | 12/2013 | Campbell | |
| 8,622,876 | B2 | 1/2014 | Kelliher | |
| 8,730,267 | B2 | 5/2014 | Petersen | |
| 8,740,752 | B2 | 6/2014 | Ellis et al. | |
| 8,762,077 | B2 | 6/2014 | Redmond et al. | |
| 8,771,151 | B2 | 7/2014 | Larsson | |
| 8,784,273 | B2 | 7/2014 | Dugan | |
| 8,812,258 | B2 | 8/2014 | Nadkarni et al. | |
| 8,858,399 | B2 | 10/2014 | Ellis et al. | |
| 8,876,738 | B1 | 11/2014 | Kahn et al. | |
| 8,882,639 | B2 | 11/2014 | Tchao et al. | |
| 8,920,287 | B2 | 12/2014 | Doshi et al. | |
| 8,939,831 | B2 | 1/2015 | Dugan | |
| 9,089,733 | B2 | 7/2015 | Fisbein et al. | |
| 9,171,201 | B2 | 10/2015 | Lake, II et al. | |
| 9,623,279 | B2 * | 4/2017 | Domeika ..... | A63B 22/0076 |
| 2003/0134719 | A1 | 7/2003 | Liou | |
| 2010/0190615 | A1 | 7/2010 | Baker et al. | |
| 2010/0197462 | A1 | 8/2010 | Piane, Jr. | |
| 2010/0240494 | A1 | 9/2010 | Medina | |
| 2011/0028278 | A1 | 2/2011 | Roach | |
| 2011/0082015 | A1 | 4/2011 | Dreissigacker et al. | |
| 2013/0225374 | A1 | 8/2013 | Lumsden | |
| 2015/0111706 | A1 * | 4/2015 | Broadhurst ..... | A63B 22/0076 482/72 |
| 2015/0258366 | A1 * | 9/2015 | Domeika ..... | A63B 69/06 482/72 |
| 2017/0319889 | A1 | 11/2017 | Cei et al. | |

* cited by examiner

EXERCISE ASSEMBLY FOR PERFORMING DIFFERENT ROWING ROUTINES

CLAIM OF PRIORITY

The present application is a continuation-in-part application of previously filed, having Ser. No. 15/367,289, filed on Dec. 2, 2016, which claims priority to a provisional patent application, namely, Ser. No. 62/352,202 filed on Jun. 20, 2016, as well as to another prior filed Provisional application, namely, Ser. No. 62/419,618 filed on Nov. 9, 2016, the contents of which are both incorporated herein by reference in their entireties.

BACKGROUND OF THE INVENTION

Field of the Invention

The present invention relates to novel land-based exercise devices that replicate the motion of kayaking and rowing. More particularly, the invention is related to an exercise device that replicates both the motion and resistance of kayaking and rowing and translates motion of the device's paddle handle into immediate corresponding motion of kayaking or rowing movement displayed in video games, videos, virtual reality videos and/or fitness tracking software.

Description of the Related Art

Physical fitness is generally considered to be beneficial to almost all individuals, from the elderly to the relatively young. The benefits of physical fitness results in an improvement in overhaul health as at least partially demonstrated by a decrease in the risk of contracting diseases, the avoidance of injury when involved in either strenuous or normal activities and the overall improvement in the quality of life. Further, involved in physical fitness activities, one usually attempts to improve body flexibility, muscular strength, and improvement in metabolic rate, cardiovascular endurance and the reduction of body fat. It is also generally accepted that physical fitness, through exercise plays a significant role in maintaining and improving and individuals mental health.

Attempts to improve one's physical fitness typically involves the performance of specialized or generalized exercise routines. As such, many such routines can be performed outdoors without the need for specialized equipment. By way of example, running or walking on a consistent basis is a well-known method of increasing one's physical fitness specifically including, but not limited to cardiovascular improvement. However, many individuals attempt to improve the physical condition of specific parts of their body and or muscle groupings in order to improve their ability to perform certain sports and or physical activities.

As an example, weight training specifically provides many functional benefits. As such weight training strengthens muscles to improve posture and provide better support for joints. Further, weight training may increase muscle mass which in turn may result in an elevation in metabolism, a weight loss and in certain more specialized situations helps one in the performance of certain sports activities.

Accordingly, some areas of physical training or exercise preferably involves the use of exercise equipment and/or machinery. Generally speaking, exercise equipment of this type generally provides a user with a degree of resistance to movement or user motion, whether the ultimate goal is building muscle mass of certain muscle groupings or increasing one's endurance. In either instance, the degree of resistance presented by specialized exercise equipment is almost always selectively variable such that different training routines and or the development of certain muscle groupings can be more efficiently and effectively accomplished.

Further by way of example, more specialized exercise machines and/or equipment are structured and operative to facilitate a user's performance of a rowing motion. Moreover, these types of exercise machines/equipment may be even more specialized depending upon the type of rowing action or motion preferred to be practiced by a user. The sport of rowing has long been recognized as an excellent form of exercise. As such, one who engages in either casual or competitive rowing can efficiently develop his/her legs, back, shoulders, arms and other areas of the body, by exercising with such rowing machines. If properly designed and operational, such rowing machines involve little trauma to the user by avoiding a pounding or like dramatic effect to the user's body. Further, known or existing rowing machines may be relatively compact and even portable as they have been adapted for use in indoor locations.

However, many known or conventional rowing machines provide user with relatively limited versatility in that many do not enable a user to perform a true rowing action corresponding to that if the user was in an actual rowboat, canoe or other preferred watercraft. In other words, the movements or motions of a user when operating such rowing machines often do not duplicate an actual or real life rowing motion. Further, many known or conventional machines of this type are not capable of meaningful or selective adjustment which allow a user to change between different rowing routines, while concurrently making adjustments to accommodate the strength, size, age, etc. of different users.

Therefore, there is a need in the exercise industry and in the general area of enhancing physical fitness for an exercise assembly capable of facilitating the performance of a variety of different rowing routines. In addition, the plurality of different rowing routines made available to a user would more closely resemble a true or real life rowing motion. As such, the different rowing motions may replicate different routines including, but not limited to, the paddling of a canoe or kayak or the motion associate with a typical row boat, wherein a user concurrently operates two rowing oars. Further, such a preferred and proposed exercise assembly should be capable of being easily changed or switched in its practiced motion such that a user may quickly and efficiently switch to a different one of a possible plurality of rowing routines such as those set forth above.

In addition, such a preferred and proposed exercise assembly should include variable resistance features to accommodate different users as well as facilitate the performance of the different rowing routines of the type indicated. Also, such a proposed exercise assembly should be sufficiently versatile and effectively operable to analyze and convert any of a plurality of different rowing motions into a digital display which in turn could be incorporated into a videogame, video program, three-dimensional virtual reality, fitness tracking program, etc.

SUMMARY OF THE INVENTION

The present invention is directed to an exercise assembly enabling a user to be seated upon the floor and/or floor supported chair or seat structure. When so disposed, the user may attempt to replicate the rowing motion and physical resistance of kayaking or rowing and translate the motion of a paddle/handle of the exercise assembly into immediate corresponding motion of kayaking or rowing movement displayed in video games, videos, virtual reality videos and/or fitness tracking software.

Exercise is performed by a user pulling on the paddle/handle with a connector structure, including a connector member attached to each of the paddle handle terminal ends. The other ends of the connector members enter the interior of the housing of the exercise assembly and are coiled around pulley members that, through individual drive axles and 4:1 gear linkage, turn a second driven axle attached driving relation to a resistance member, such as a fan structure, inside and the air chamber. Rotating fan blades push against atmospheric pressure of the air within the interior of the air chamber and thereby providing resistance to the users' motion. The amount of air resistance against the fan blades is adjustable by variably opening or closing vents that control the amount of airflow between the fan chamber and the exterior of the device. Adjusting the amount of airflow into the chamber adjusts the level of difficulty for a user to pull the paddle/handle. As either end of the paddle handle is pulled, the connector member attached to the same paddle handle terminus turns a pulley on a corresponding one of the drive sections of the drive assembly. Each pulley is attached to a separate first drive axle, which is attached to a drive gear. Each of the drive gears are disposed into meshing, driving engagement with a correspondingly disposed driven gear connected to and rotational with a driven axle. When pulling motion on one or both of the pulley stops, the resistance device and/or fan structure continues to spin via a clutch and/or freewheel mechanism incorporated into the pulley systems and/or linkage associated with the drive sections. When pulling motion is reversed, a coiled tension spring integrated into the pulley system rotates the pulley in the opposite direction and retracts the strap to wind back around the pulley.

A user sits upon the ground or a seat in front of the housing of the exercise assembly and places their feet upon the foot or retention plates associated there with. The device sits upon a movable support which may include a plurality of wheels, castors, rollers, etc. Moreover, the movable support can be set in a locked (unmovable) or unlocked (movable) orientation. When performing kayaking exercises, the movable supports are placed in the locked position.

During kayaking exercises, a seat which may be composed of a fabric bottom and backrest can be attached to the device via straps, providing back support for the user. The shape of the lower surface of the seat can be altered by attaching different panels to the lower surface of the seat. The flat upper surface of the panels connects via clips and straps to the flat lower surface of seat. The lower surface of the panels can be constructed of a variety of curved shapes or inflatable elastic material which enable the seat to tilt on the ground in a portion of or full 360 degrees. Countering this tilting motion engages muscles of the user. When wheels are unlocked, the device can roll forward and backward on the ground. Rowing-device type exercises can be performed on the device when the wheels are unlocked and the user pulls equally on both sides of the paddle handle while extending the legs away from their body while in a seated position. This movement pushes the device away from the user. Straps on the foot rests that secure the users' feet to the foot rests enable the device to be pulled back toward the user while the pulley mechanism retracts the straps onto the pulleys.

Attached to the paddle/handle is a motion sensor which may include an accelerometer, gyroscope, etc. and wireless communication such as, but not limited to, Bluetooth capabilities device that tracks the 3-dimensional movement of the paddle and transmits the motion of the paddle/handle to a nearby processor/display assembly including, but not limited to, smartphones, tablets, or virtual reality goggles. Such display devices may include software which translates and integrates the movement information or "motion data" into matching 3-dimensional paddle movement and projected 3-dimensional movement of a kayaker or rower and/or a kayak and/or rowing boat displayed within video games, videos, virtual reality videos, and fitness tracking software. The motion data from the accelerometer, gyroscope, etc, can be interpreted by the processor/software associated with the display assembly to display kayaker/rower and kayak/rowing boat movement tracking and fitness measurement and information including, but not limited to, number of paddle strokes, speed of boat movement, distance traveled, power of strokes.

In more specific terms, the exercise assembly of the present invention is structured to perform a plurality of different rowing routines, where in each rowing routine is defined or characterized by at least one different rowing motion. By way of example only, a rowing motion associated with "kayaking" may typically include a user moving a handle in the manner commonly associated with a kayak paddle. As such, different blades or ends of a kayak paddle will alternately enter the water to propel the kayak forward. In contrast, a conventional rowing motion associated with a typical row boat will define a different routine. As such, the rowing motion associated with the propulsion of a rowboat typically involves the movement of the handle of the exercise assembly, by a user, in a manner resulting in both "oars" associated with the rowboat being concurrently moved. Therefore, such a rowing motion associated with a rowboat routine will in the blade end of each "oar" concurrently entering the water.

As generally recognized and set forth above, the "rowing motion" associated with kayaking differs significantly from the rowing motion associated with the propulsion of a conventional rowboat. Therefore, the rowing motion of a user of the exercise assembly of the present invention will move the handle in the same manner as he/she would move the paddle or oars if actually kayaking, rowing, etc. As a result, each of a possible plurality of different rowing motions of the handle, performed by the user, will represent a different "rowing routine". Therefore, the exercise assembly of the present invention demonstrates an enhanced versatility in allowing a user to perform different rowing routines depending on his/her preference.

As set forth in greater detail hereinafter, structural and operational components of one or more preferred embodiments of the exercise assembly of the present invention includes a movable or rotational chamber. The chamber may be more specifically defined as an air chamber through which a flow of air passes, while being at least partially, temporarily retained or captured therein. A resistance element is removably or more specifically rotationally mounted within the air chamber and is structured to resist rotation therein due to interaction with the flow or at least partially retained air within the air chamber. As such, the resistance device made assume a fan or fan-like structure having a plurality of blades of the vanes collectively and cooperatively disposed to interact with the air within the chamber. Such interaction between the blades and/or other components of the resistance device/fan will result in a resistance to the rotation of the resistance device and thereby provide resistance to a user, causing the resistance device/fan to rotate.

Interaction between a user and forced movement of the resistance device is accomplished through the provision of a drive assembly connected in driving relation to the resistance device. Further, a handle, which effectively serves as a "paddle", is manipulated by the user to the extent of performing a plurality of different "rowing motions". As set forth above each rowing motion may be representative of a different "rowing routine". As also set forth above, each of a plurality of different rowing motions may duplicate or be substantially similar to the rowing motion of performed by an individual actually involved in kayaking, rowing, canoeing, etc.

The handle is connected in driving relation to the drive assembly by a connector structure. Accordingly, movement of the handle through anyone of a plurality of different rowing motions results in the connector structure driving the drive assembly, which in turn drives/rotates the resistance member within the air chamber. At least one operative and structural feature of the exercise assembly of the present invention includes the drive assembly including at least two drive sections. Each drive section is independently connected to the resistance device such that the resistance device may be independently driven/rotated by either of the two drive sections. Further, depending on the rowing motion applied to the handle by the user, the two drive sections may concurrently drive/rotate the resistance device. Also by way of example, when a user moves the handle in a rowing motion associated with kayaking, each of the drive sections will be alternately disposed in driving relation to the resistance device. In contrast, when a user moves the handle in a manner associated with conventional, two oar rowing, each of the two drive sections will be concurrently disposed in driving relation to the resistance device.

As generally set forth above, the exercise assembly of the present invention also includes a motion sensor mounted on or otherwise operatively associated with the handle. As such the motion sensor will detect and process each "rowing motion" of the handle, as performed by a user, such as through the operative features of an accelerometer, gyroscope or other motion analyzer/detector. Further, the motion analyzer will generate or establish a set of "motion data" which distinguishes each of a plurality of different rowing motions from one another. Such motion data will then be transmitted to a display assembly, which includes a processor and possibly a software application facilitating the processing of the received motion data and the conversion thereof into digital display signals. The display signals may be further processed and as a result may be visualized in the form of a replication of a user, actual paddle, watercraft, etc. performing the "real life" rowing motion, which the user of the exercise assembly is attempting to perform using the handle of the exercise. Any of a plurality of mobile or fixed processor/display devices may be used to view the generated display.

Therefore, the exercise assembly of the present invention including each of a possible plurality of different preferred embodiments demonstrates a significant degree of versatility which allows one or more users, independent of age or gender, to perform a variety of different exercises through the performance of different "rowing motions" which define or represent different "rowing routines".

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
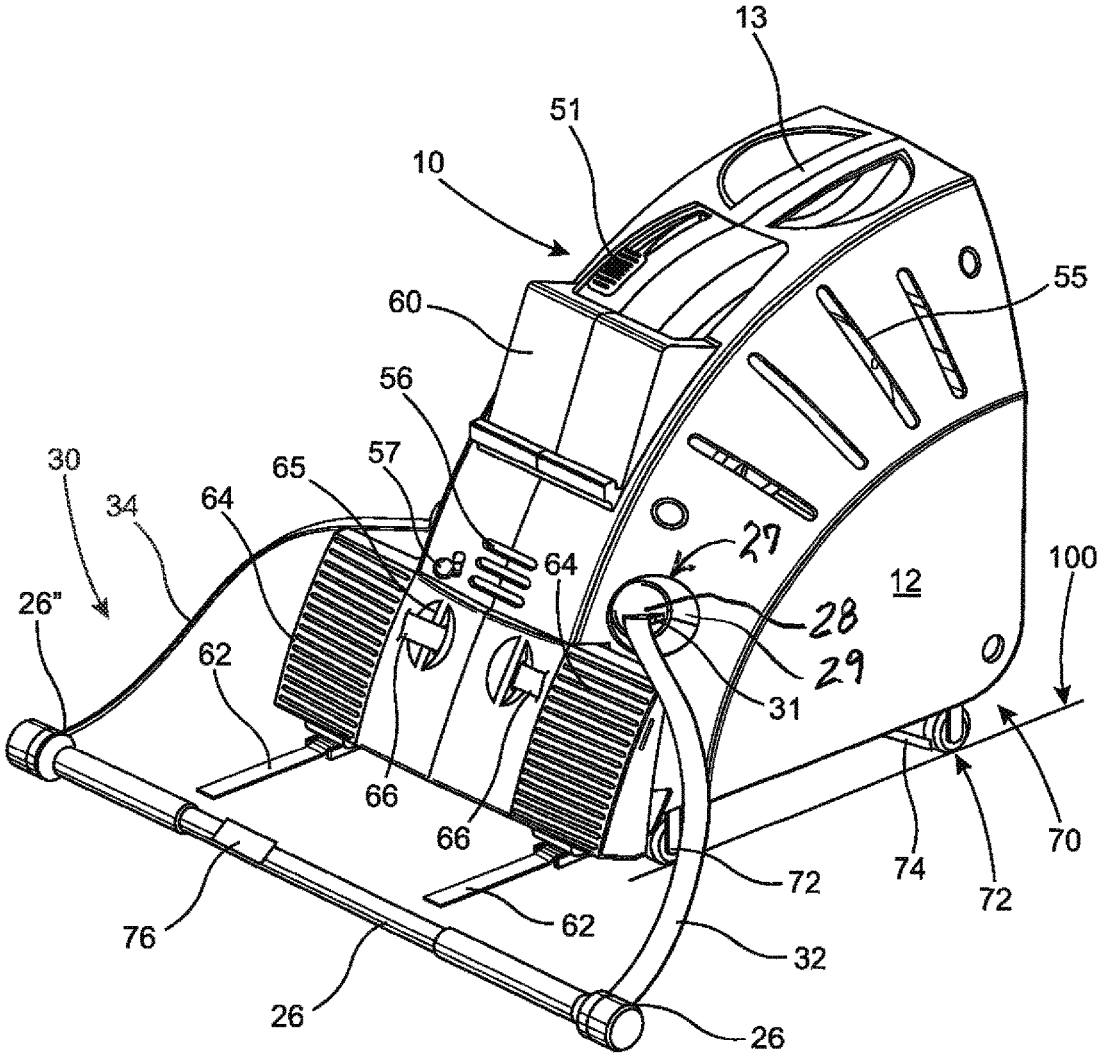
FIG. 1 is a perspective view of at least one preferred embodiment of the exercise assembly of the present invention.

As represented in the accompanying Figures, the present invention is directed to an exercise assembly generally indicated as 10 including a housing 12 disposed in enclosing relation to a chamber generally indicated as 14. The chamber 14 as explained in greater detail with reference to FIGS. 3 and 4 may be more accurately and definitively described as an air chamber through which air flows and in which air is at least partially or temporarily retained. In addition, the exercise assembly 10 of the present invention includes a resistance device, generally indicated as 16, which is preferably in the form of fan or fan-like structure having a plurality of blades 18. The blades 18 are preferably, but not necessarily, disposed about an interior periphery of the resistance device/fan structure 16.

The resistance device 16 is rotationally driven within the interior 14' of the air chamber 14 through activation of a drive assembly generally indicated as 20. The drive assembly 20 is represented in greater detail in FIG. 6 and includes at least two drive sections 22 and 24 each structured to independently and concurrently drive/rotate the resistance device/fan 16. Further, driving activation of the drive assembly 20 is accomplished by movement of a handle 26 through a variety of different "rowing motions" by a user (not represented in the accompanying Figures). Movement of the handle 26 through a variety of possible, different rowing motions results in driving of the drive assembly 20 including the alternate or concurrent driving of each of the driving sections 22 and 24. As such, the handle 26 is connected in driving relation to the drive assembly 20 by a connector structure 30, preferably including two connector members 32 and 34. As should be noted, each of the connector members 32 and 34 pass through the interior of the housing 12, through a ball joint mounting 27, which includes a ball 28, having an opening 31, and being movably disposed within a cavity 29. Further, each of the connector members is attached to a different one of the drive sections 22 and 24.

In more specific terms, each of the connector members 32 and 34 enter the body 12 through the opening or aperture's 31 formed in correspondingly positioned ones of the spherical balls 28 of the different ball joint mountings 27. In addition, each of the balls 28 are made of a low-friction material movably disposed in an at least partial universal range of motion within corresponding ones of the cavities 29. The dimension and or length or other cross-section dimension of each of the openings 31 is slightly larger than the corresponding transverse dimension or cross-section of the connector members 32 and 34. This allows each of the connector members 32 and 34 to pass through the opening 31, where in the ball 28 is loosely disposed and movable within the low friction cavity. This enables the ball 28 to slide within the cavity and rotate in at least three dimensions.

Also, the opposite or outer, exposed portions of the connector members 32 and 34 are connected to the handle 26 in spaced relation to one another such as at, but not limited to, the opposite distal or free ends 26, and 26". By virtue of spaced apart connection of the connector members 32 and 34 to the handle 26, the different rowing motions capable of being performed by a user more closely represent the actual, real-life rowing motion associated with kayaking, conventional rowing, canoeing, etc.

Figure 6:
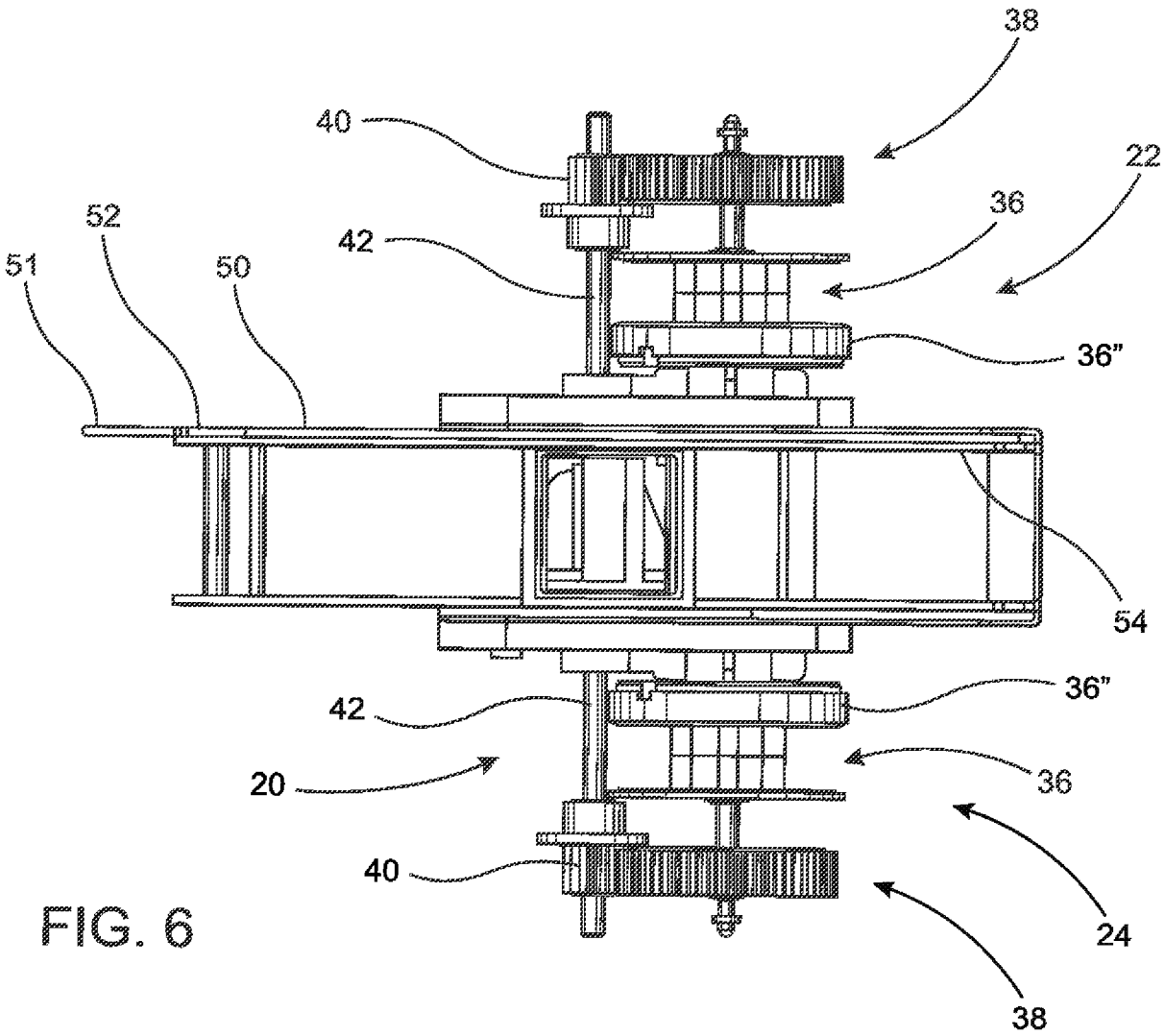
FIG. 6 is a top view of the interior structure and components primarily of the embodiment of FIGS. 3 and 4.

With primary reference to FIG. 6, at least one preferred embodiment of the drive assembly 20 includes at least two drive sections 22 and 24, as set forth above. Further, each drive section 22 and 24 includes a pulley 36 connected to a correspondingly positioned, different one of the connector members 32 and 34. As such, the exertion of a pulling force on the handle 26 results in the connector members 32 and 34 exerting a concurrent or alternate pulling force on the respective pulleys 36. Such a pulling force in turn results in the rotation of the corresponding pulleys 36. Each pulley 36 is connected and forces rotation of a different driving gear 38. As such the rotation of the respective pulleys 36 in turn causes a rotation of respective ones of the driving gears 38.

As also represented in detail in FIG. 6, each of the driving gears 38 are connected in intermeshing, driving engagement with a driven gear 40. Moreover, each of the driven gears 40 are connected to and rotational with a different drive axle 42. In addition, each drive axle 42 is independently connected and/or disposed in driving engagement with the air chamber 14, through appropriate linkage. Further, such appropriate linkage is operative to independently and/or concurrently dispose the different drive axles 42 in driving in relation to the air chamber 14 and may include a clutch and/or "freewheeling" structure. Such clutch/freewheeling structure allows the air chamber 14 to continue to rotate in an intended direction, concurrently to a retraction or rewinding of the connector members 32 and 34 on respective/corresponding ones of the pulleys 36.

Figure 8:
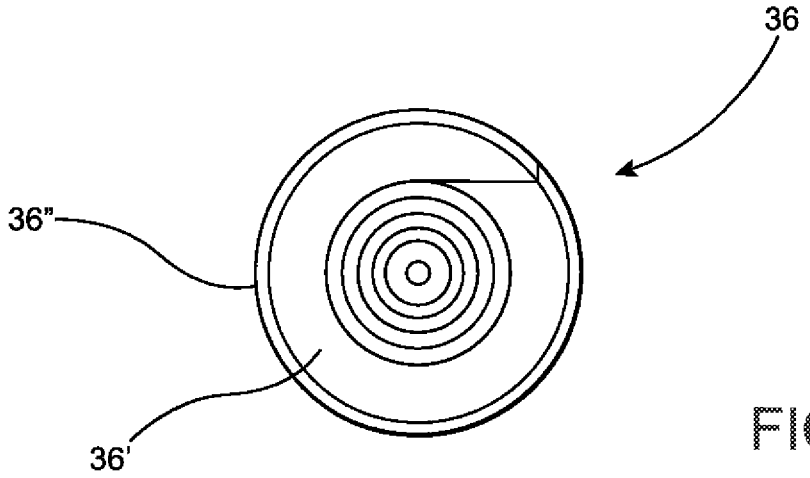
FIG. 8 is a detailed interior schematic view of operative components of the embodiment of FIGS. 1-6.

As represented in FIG. 8, each of the pulleys 36 may include a biasing member 36' disposed on an interior of a casing 36". The biasing member 36' is disposed and structured to facilitate the respective pulley 36 being "rewound" by rotating in an opposite direction, once a pulling force, exerted thereon by corresponding ones of the connector members 32 and 34, is no longer being applied thereto. Such rewinding of the pulley members 36 will result in a rewinding of corresponding connector members 32 and 34 back onto the corresponding pulley 36, so as to be operationally positioned to exert the next pulling force on the corresponding pulleys 36.

Further, such a biasing member 36' may be in the form of a coil spring or other biasing structure which facilitates a reverse rotation of the corresponding ones of the pulleys 36 once a pulling force is no longer exerted thereon by the handle 26 and a corresponding one of the connector members 32 and 34. Once rewound, each pulley 36 will thereby be in a position to again exert a driving, rotational force on corresponding ones of the drive gears 38 concurrent to corresponding ones of the connector members 32 and 34 exerting a pulling force thereon through movement/pulling/manipulation of the handle 26 by a user. In addition, each of the pulley members 36 may also be connected to corresponding ones of the drive gears 38 by an appropriate clutch mechanism and/or freewheeling drive structure. As a result, a reversed, rewinding rotation of each of the pulleys 36 is permitted without causing a concurrent reversed rotation of the drive gears 38. However, such a clutch mechanism/freewheeling structure may be associated directly with the drive axles 42. In such an embodiment, each of the drive gears 38 would rotate in a reverse orientation upon a rewinding of the pulley 36 and in turn cause the driven gears 40 and corresponding drive axles 42 to freely rotate without driving or interfering with the intended direction of rotation of the air cylinder 14.

As set forth above and otherwise herein, resistance to movement and/or rotation of the resistance device/fan structure 16 within the interior 14' of the air chamber 14 is a result of resistive, interaction of the plurality of fan blades 18 with air within the interior 14'. Such resistance to rotation of the resistance device 16 within the chamber interior 14' may be at least partially dependent on the quantity and/or flow of air within and through the air chamber 14.

Figure 3:
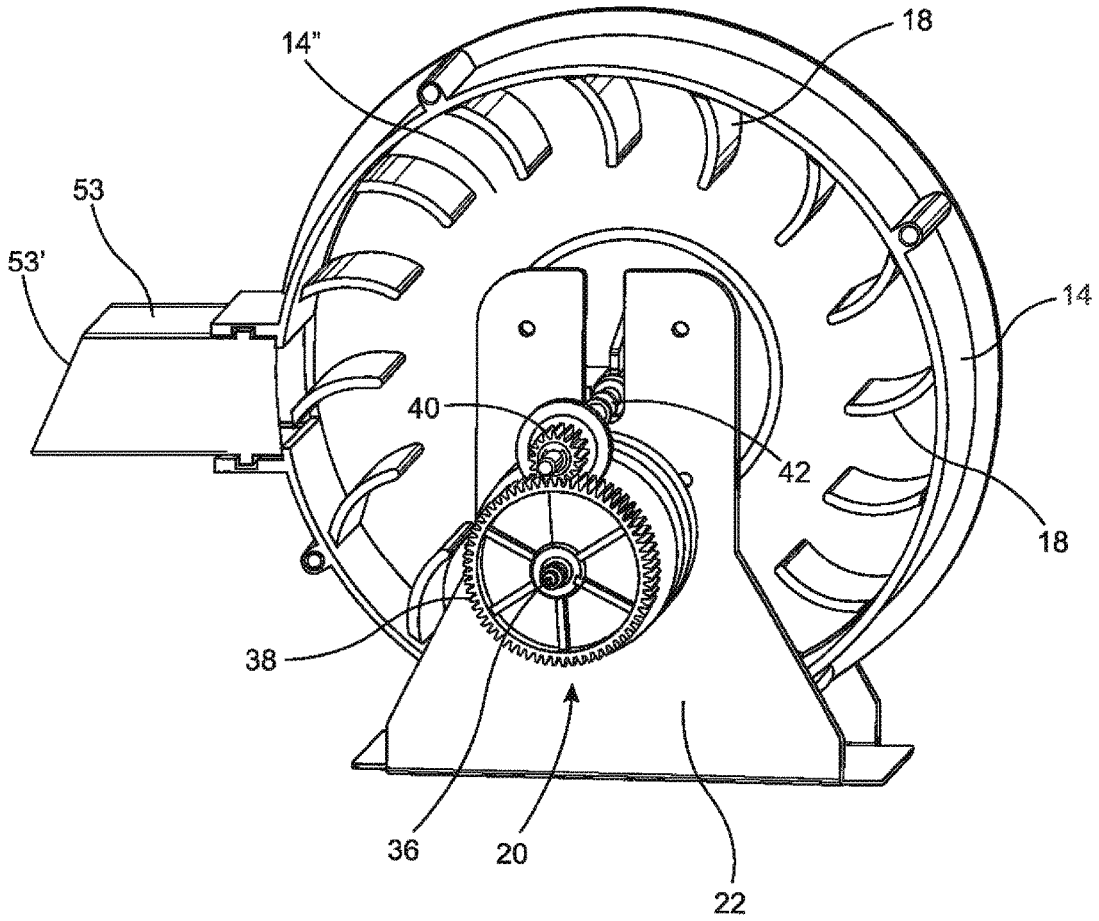
FIG. 3 is a perspective, interior detail view of the embodiment of FIG. 3.
Figure 4:
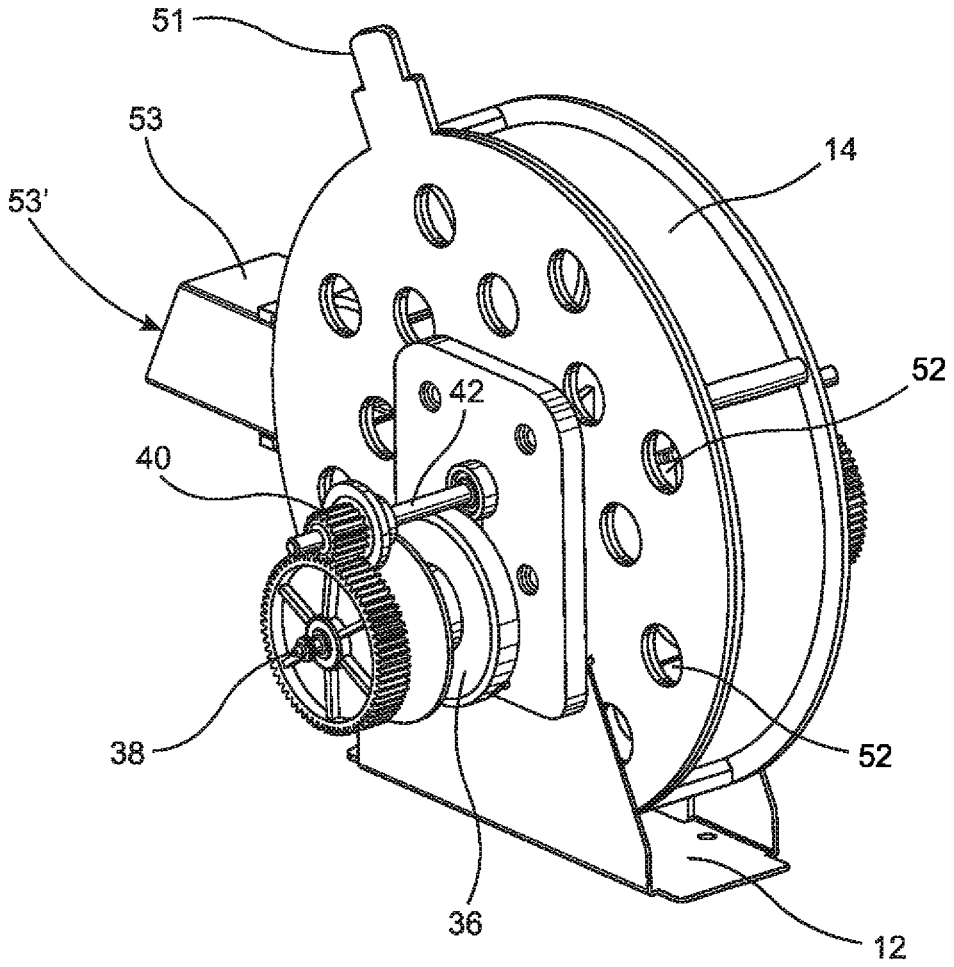
FIG. 4 is a perspective view of the interior, operative components of the embodiments of FIGS. 1-3.
Figure 5:
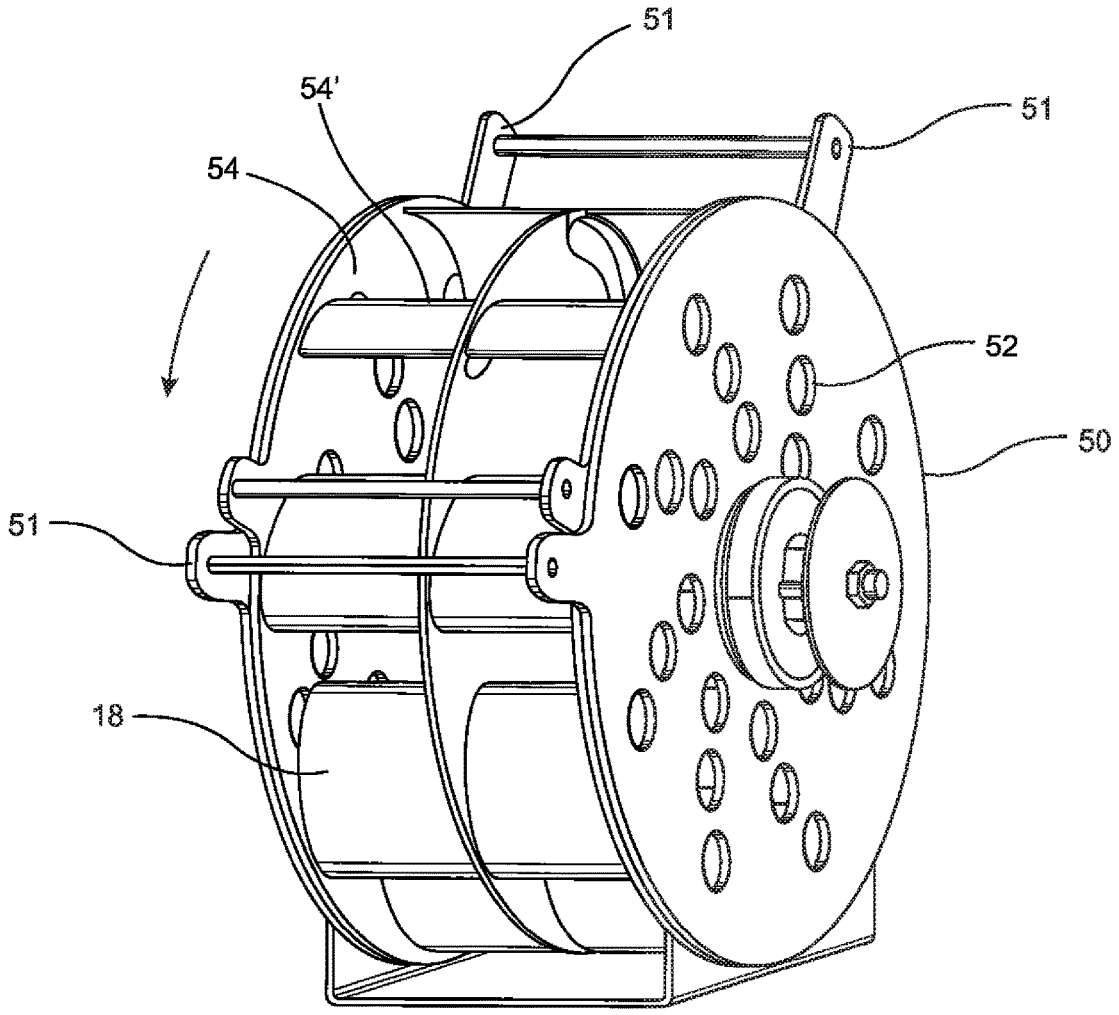
FIG. 5 is a detailed view in perspective of the structural components represented in FIGS. 3 and 4.

Accordingly and with primary reference to FIGS. 3-5, the exercise assembly 10 of the present invention includes an air intake generally indicated as 50. The air intake 50 may include a rotationally mounted plate or like structure having an apertured configuration including at least one, but more practically, a plurality of apertures as at 52. Further, the air chamber 14 preferably includes dual air inlets 54, which may be defined by spaced apart walls or sides of the air chamber 14. Each of the air inlets 54 also includes at least one or a plurality of openings or apertures 54'. The air intake 50 is movable relative to the dual air inlets 54, by manipulation of the knob or like structure 51, to accomplish rotational or other appropriate movement of the air intake 50. Such adjustment or movement of the air intake 50 results in an alignment or misalignment of the corresponding apertures 52 in the air intake and the apertures 54' in each of the dual air inlets. As should be apparent, an alignment of the apertures 52 and 54' will in turn result in a greater flow of air passing into and through the interior 14' of the air chamber 14 from an exterior thereof. In contrast, a purposeful misalignment of the apertures 52 and 54' will result in less air flowing into the interior 14' of the air chamber 14.

Figure 2:
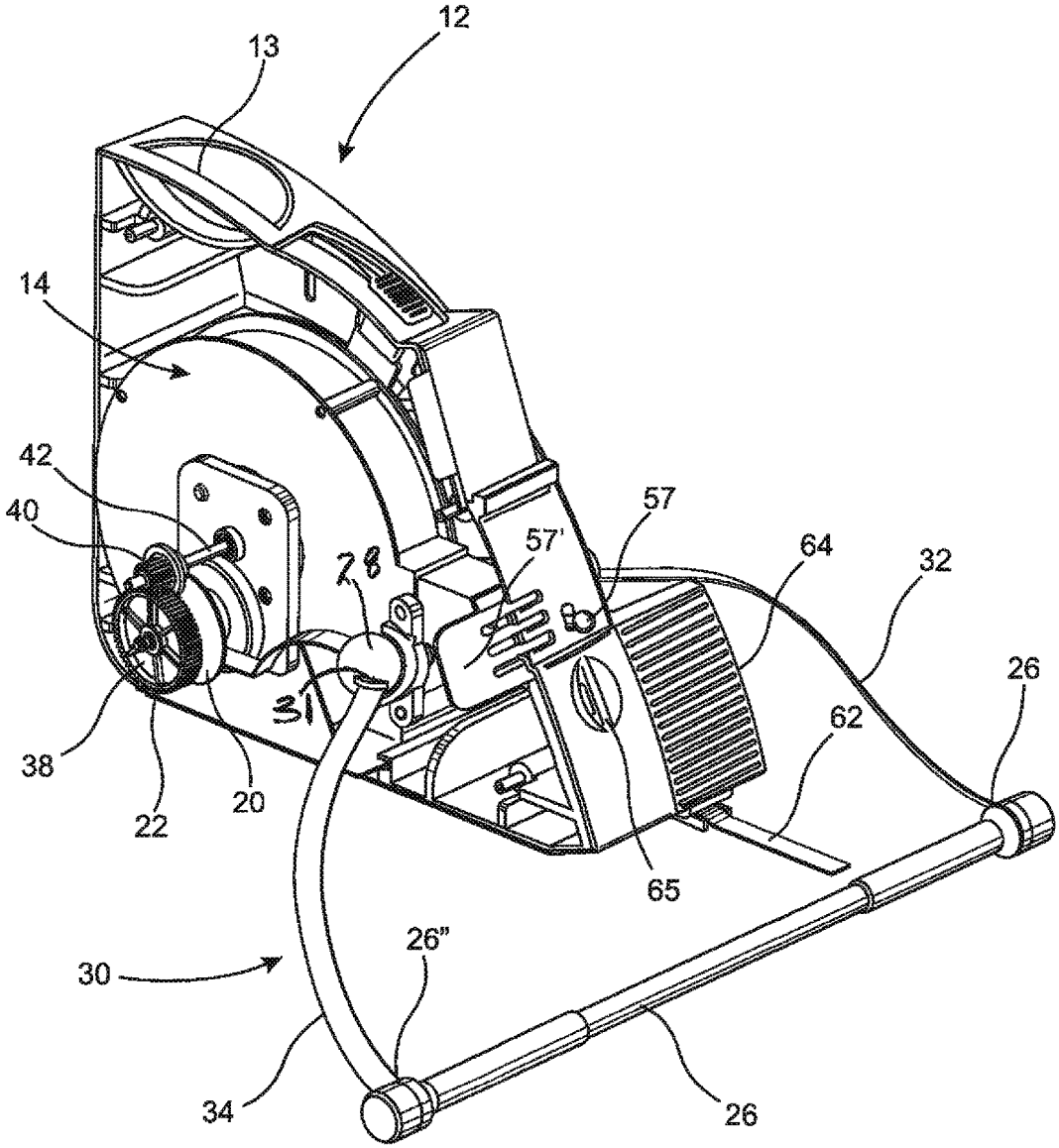
FIG. 2 is a perspective view in partial cutaway representing both exterior and interior portions of the embodiment of FIG. 1.

The air at least partially and temporarily retained within the interior 14' of the air chamber 14 is also regulated through the provision of an exhaust or exit 53 having an open end 53' through which air exits from the chamber interior 14'. Further, as represented in FIGS. 1 and 2 the housing 12 includes a plurality of vents 55 and 56 which are respectively disposed and structured to allow the intake and exiting of air there through. As such, air may pass into the interior 14' of the air chamber 14 through vents 55 and exit the interior 14' through the open and 53' of the exhaust 53 and also through the exhaust vents 56. As also represented in FIGS. 1 and 2, the amount of air exiting the air chamber interior 14' through the exhaust vents 56 and aligned opening 53' of the air exhaust 53 may be regulated to the extent of being at least partially opened or closed. Such regulation may occur by manipulation of a knob or like structure 57 which controls the positioning of an exhaust regulator structure 57' disposed and structured to at least partially enclosed within its 56.

As such, a closing of the vents 56 will result in more air being retained within the interior 14'. In contrast an opening of the vents 56 will result in a free flow of air through the interior 14', assuming that the corresponding openings or apertures 52 and 54' of the air intake 50 and air inlet 54 are at least partially aligned.

Yet additional structural features associated with one or more preferred embodiments of the exercise assembly 10 include the housing 12 having a handle 13 facilitating the lifting and or otherwise positioning of the housing 12 in a variety of different locations. The housing 12 also includes a support area or platform 60 mounted on an exterior portion thereof and being dimensioned and structured to support or be structurally associated with a display assembly, generally indicated as 80, to be described in greater detail with specific reference to FIG. 7. Also, the housing 12 may include straps or like structures 62 serving to interconnect the housing 12 with an appropriate seat or other user support structure for operative and proper positioning of a user relative to the housing 12, handle 26 and connector structure 30.

When so positioned, the housing 12 also includes a retaining assembly including foot or engagement pads 64 for placement of a user's foot or other appropriate portion of the user body. Also, the retaining assembly may include retaining members 66 such as one or more straps, belts or other appropriate retaining members. When in use, the retaining members 66 engage the user's feet in a manner which allows the user to move relative to the housing 12 during the performance of certain one or more rowing motions. In addition the retaining member 66 are structured to allow movement of the housing with and relative to the user when he is attached to the retaining members 66, such as being engagement with the engagement pads 64.

In more specific terms, the housing 12 includes a movable support generally indicated as 70, which may be in the form of one or more rollers, castors, or like movable support member 72 serving to support the housing 12 on a supporting surface 100. Further, the movable support 70 and each of the one or more movable support members 72 may be operatively associated with a locking structure or assembly 74. The locking assembly 74 may be selectively disposed between a "locked" and "unlocked" position relative to the movable support members 72. When in the locked orientation the housing 12 is fixed relative to the supporting surface and relative to the operative position of a user, when in use. As a result, the user may move relative to the housing 12 when performing the various rowing motions, such as a rowing motion associated with kayaking.

In contrast, when the one or more locking members 74 are disposed in a locked orientation relative to the movable support member 72, the housing 12 may move over the supporting surface 100. Therefore, when the user performs any one of a plurality of different rowing motions, the housing 12 and the user may move relative to one another. Such relative movement is facilitated by the retaining straps or like member 66 engaging the feet or other portion of the user. For example, the extension and retraction of a user's legs will result in the movement of the user relative to the housing 12 and in certain instances the concurrent movement of the housing 12 and user, relative to one another, such as when performing a conventional two "oar" rowing motion.

Figure 7:
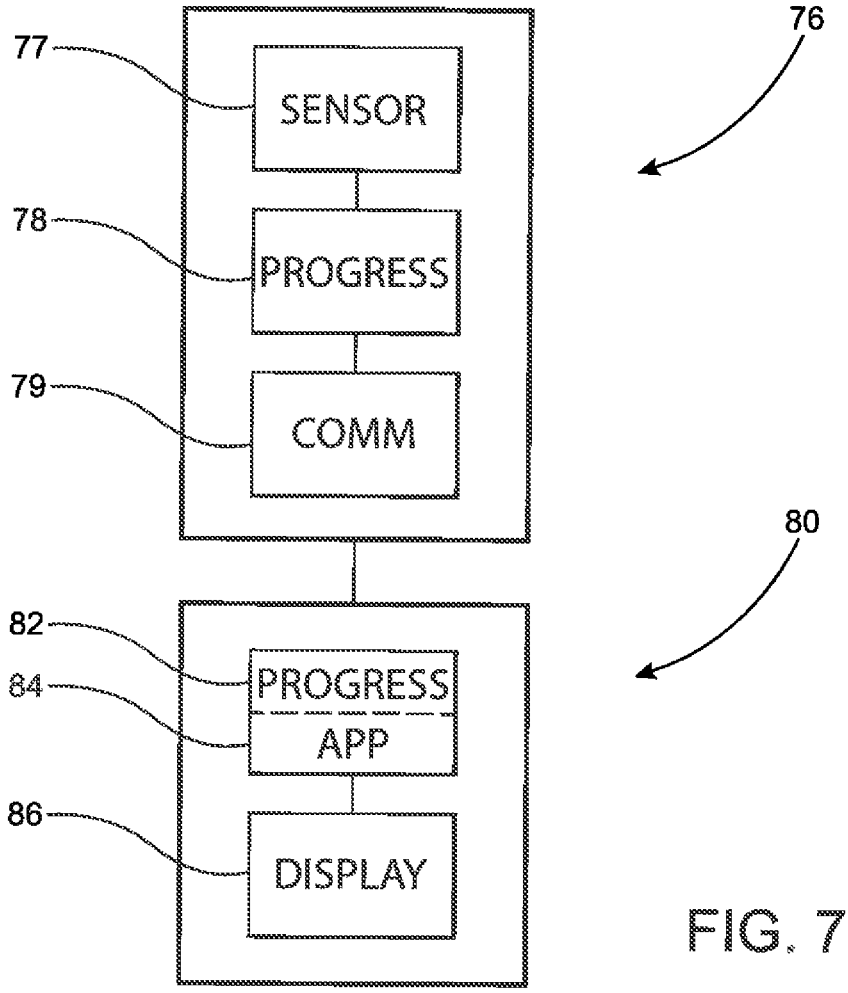
FIG. 7 is a schematic representation of a motion sensor assembly and operatively associated display assembly usable with the embodiments of at least FIGS. 1-6.

One or more preferred embodiments of the exercise assembly 10 of the present invention also includes a motion sensor assembly 76, as schematically represented in FIGS. 1 and 7. The motion sensor assembly 76 is connected to, mounted on or otherwise operatively associated with the handle 26. As such the motion sensor assembly 76 will include a sensor device which may have the operative capabilities of an accelerometer, gyroscope or other analyzer component 77 operative to detect and process, in cooperation with a processor 78 each "rowing motion" of the handle 26, as performed by a user. Further, the motion sensor assembly 76, through operative association with the analyzer 77 and processor 78, will generate or establish different "motion data" which distinguishes each of a plurality of different rowing motions from one another. Such motion data will then be transmitted, via a short range or other operable communication facility 79, to a display assembly 80.

The display assembly 80, including a processor 82 associated therewith, may also include a software application 84 facilitating the processing of the received motion data and the conversion thereof into display signals. In turn, the display signals may be transmitted to and visualized on a display device 86. The visual representation on the display device 86 may be in the form of a replication of a user, actual paddle, watercraft, etc. performing the "real life" rowing motion or movement which the user of the exercise assembly is attempting to perform using the handle 26 thereof. The visual representation on the display device 86 may be in the form of or incorporated within video games, videos, virtual reality videos and/or fitness tracking software, etc. Further, the display assembly may comprise or include smartphones, tablets, or virtual reality goggles with appropriate software 84, which translates and integrates the motion data into matching 3-dimensional paddle movement and projected 3-dimensional movement of a kayaker, rower and/or a kayak and/or rowing boat, displayed within video games, videos, virtual reality videos, and fitness tracking software.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly structured to perform different rowing routines, said exercise assembly comprising:

a housing comprising a chamber including a resistance device movably disposed therein, said resistance device cooperatively structured with said chamber to resist rotation thereof within said chamber, a drive assembly including two drive sections independently connected in driving relation to said resistance device;

a handle and a connector structure; said connector structure comprising at least two connector members each disposed in driving relation between said handle and a different one of said drive sections, said handle concurrently movable with and relative to said driving assembly, through a plurality of different rowing motions, at least one of said plurality of different rowing motions of said handle defined by said at least two drive sections concurrently connected in driving relation to said resistance device and in driven relation to interconnected ones of said at least two connector members, at least one other of said plurality of different rowing motions of said handle defined by each of said at least two drive sections alternately connected in driving relation to said resistance member and in driven relation to interconnected ones of said connector member, two ball joint mountings each including a cavity formed on an exterior of said housing, each of said ball joint mountings including a ball movably mounted within a corresponding one of said cavities, and each of said balls including an opening dimensioned to allow passage of a different one of said connector members there through into said chamber.

2. The exercise assembly as recited in claim 1 further comprising a motion sensor assembly configured to detect and process said rowing motion of said handle, said motion sensor assembly structured to configure motion data associated with said processed rowing motion and said motion sensor assembly including transmission capabilities operative to transmit said motion data to a corresponding interactive display.

3. The exercise assembly as recited in claim 2 said motion data configured to replicate said rowing motion of said handle into a corresponding one of the rowing routines for visualization on the interactive display.

4. The exercise assembly as recited in claim 1 wherein each of said two connector members passes through a different one of said ball joint mountings into connected relation with a different one of drive sections.

5. The exercise assembly as recited in claim 1 where in each of said balls are disposable in and at least partially universal range of movement within a corresponding one of said cavities.

* * * * *